US006557175B2

(12) United States Patent
Greenblatt

(10) Patent No.: US 6,557,175 B2
(45) Date of Patent: May 6, 2003

(54) CONVERTIBLE GARMENT

(76) Inventor: Leni S. Greenblatt, 15 W. 63rd St. Apt. 39A, New York, NY (US) 10028

( * ) Notice: Subject to any disclaimer, the term of this patent is extended or adjusted under 35 U.S.C. 154(b) by 0 days.

(21) Appl. No.: 10/041,266

(22) Filed: Jan. 8, 2002

(65) Prior Publication Data

US 2002/0088047 A1 Jul. 11, 2002

Related U.S. Application Data

(60) Provisional application No. 60/260,634, filed on Jan. 8, 2001.

(51) Int. Cl.[7] ..... A41D 13/00

(52) U.S. Cl. ..... 2/69; 2/243.1

(58) Field of Search ..... 2/105, 106, 108, 2/102, 113–115, 83, 80, 85, 93, 94, 95, 69, 90, 69.5, 66, 227, 228, 238, 79, 400, 403, 406, 408, 243.1, 78.1–78.3, 109, 111; D2/700, 701, 703, 706–708, 711, 712, 716, 717, 731, 734, 829, 840, 844–848, 854, 861–864

(56) References Cited

U.S. PATENT DOCUMENTS

| | | | | | |
|---|---|---|---|---|---|
| 2,603,788 | A | * | 7/1952 | Page | 2/90 |
| 4,266,299 | A | * | 5/1981 | Beal | 2/227 X |
| 4,821,343 | A | * | 4/1989 | Quealy | 2/102 |
| 5,033,124 | A | * | 7/1991 | Bucalo et al. | 2/227 |
| 5,138,716 | A | | 8/1992 | Deuschle | |
| 5,842,230 | A | | 12/1998 | Laudick | |
| 6,434,751 | B1 | * | 8/2002 | Gustafson et al. | 2/113 |

* cited by examiner

*Primary Examiner*—Gloria M. Hale
(74) *Attorney, Agent, or Firm*—Katten Muchin Zavis Rosenman

(57) ABSTRACT

A convertible garment comprises an article of clothing originally intended to be worn on a person's legs, such as pants, shorts or the like, with a neck-sized portion of the crotch section removed so that such modified clothing article can also be worn on the upper body. Portions of the original clothing article may be further modified, manipulated or removed to vary the appearance and utility of the modified clothing article.

20 Claims, 10 Drawing Sheets

CONVERTIBLE GARMENT

CROSS-REFERENCE TO RELATED APPLICATION

This application claims priority under 35 U.S.C. §119(e) from provisional application No. 60/260,634 filed Jan. 8, 2001.

FIELD OF THE INVENTION

The present invention relates to a convertible garment in general, and more specifically to a garment that can be worn on the legs as well as the arms.

BACKGROUND OF THE INVENTION

People often wear articles of clothing in a manner not originally intended by the manufacturer. A simple example is the intentional tearing or ripping of jeans to create a worn, tattered appearance. Another example is represented by the individual that wears clothing that is way too small or way too big, i.e., the oversized, baggy look.

Most of these examples represent short-lived fads. For the most part, people purchase and wear clothing that fits. The style, coloring or overall look may change with the times, obviously, and in some cases such styles cycle between being fashionable and unfashionable throughout the life of the wearer.

However, regardless of the type, style, color, material or size of the clothing item, everyone experiences the problem of clothing that is simply too worn, too old or just doesn't fit anymore. When faced with such a problem, the usual solution is to replace such clothing items with new ones, with the old garments being donated to charitable causes, thrown out or handed down to younger generations.

Creative individuals have found ways to convert unwanted clothing into articles of desire. Whether it is called recycling or designing, the concept of taking something old and reviving it, or making something new, is alive and well in the garment industry.

For instance, in U.S. Pat. No. 5,138,716 to Deuschle, a jacket is created in a piecemeal fashion from multiple pairs of jeans. The jeans, which used to be worn on the legs, are taken apart and manipulated into a garment that is worn on the torso. Similarly, in U.S. Pat. No. 5,842,230 to Laudick, a halter top is formed out of a pair of jeans by removing the waistband from a pair of jeans to form a body strap, removing two pockets and attaching the same to the waistband to form breast cups and attaching connecting straps between the waistband and the pockets. In both cases, the identity of the original clothing items (i.e., jeans) becomes transformed and replaced by the identity of the new clothing item (i.e., jacket or halter top), such that the original clothing items are not longer capable of being used or worn in any fashion.

The present inventor has devised a new way of manipulating a garment such that the garment can be transformed into a new article of clothing, yet still be worn on the part of the body as originally intended by the manufacturer. Specifically, the present invention comprises a method of converting a pair of pants into a garment that can be worn both as a top and as a pair of pants, and a convertible garment created from such method. Such convertible garment can be formed from an old article of clothing to recycle the same, or from a new article of clothing to create an entirely different look from such article.

SUMMARY OF THE INVENTION

A convertible garment comprises an article of clothing originally intended to be worn on a person's legs, such as pants, shorts or the like, with a neck-sized portion of the crotch section removed so that such modified clothing article can be worn on the upper body. When worn on the upper body, the legs of the original clothing article become the arm sleeves of the modified clothing article. The modified clothing article can also continue to be worn on the legs as long as the person's body behind the now-removed crotch portion is sufficiently concealed by a suitable undergarment. The original clothing article may be further modified to vary the appearance and utility of the modified clothing article.

DETAILED DESCRIPTION OF THE PREFERRED EMBODIMENTS

Figure 1:
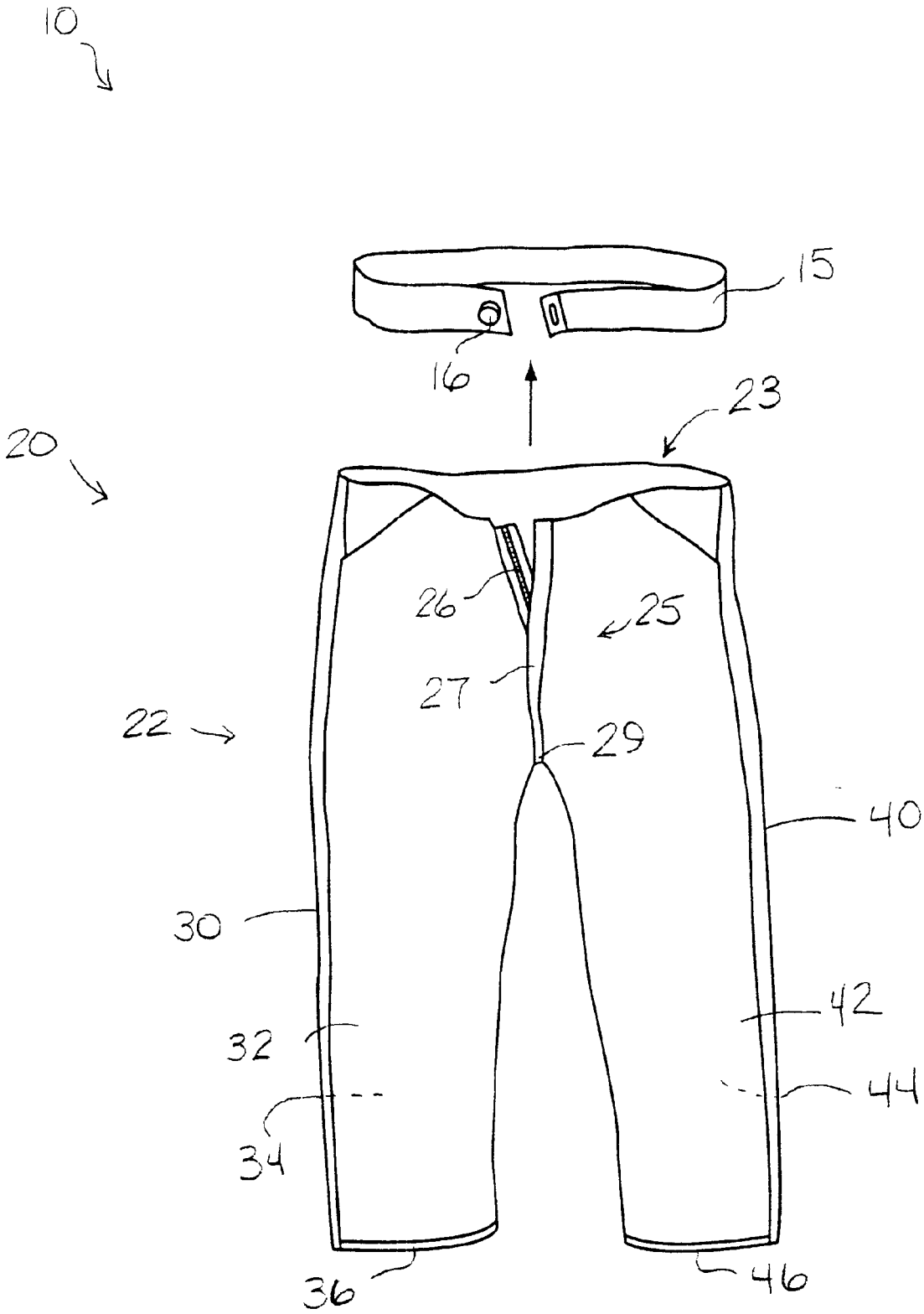
FIG. 1 illustrates a pair of pants to be converted into a convertible garment of the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

The garment of the present invention can be considered a convertible garment and a method of recycling and/or modifying pant-type garments such as jeans, sweatpants, shorts and the like, of any size, shape and material. One embodiment of a garment to be converted is shown in FIG. 1, which illustrates a pair of pants 10 having a waist portion 15, a leg portion 20, a crotch portion 25, a front 22 and a back 23. The leg portion 20 is further defined by first and second legs 30, 40, each having front panels 32, 42, back panels 34, 44 and leg openings 36, 46 respectively. The waistband 15 is usually provided with some type of closure 16, such as a snap closure, button closure or the like, with a button closure being shown for purposes of explanation. The crotch portion 25 is also usually provided with a closure 26, such as a zipper fly, a button fly or the like, that terminates at a location 27 between the first and second legs 30, 40 and spaced above the lowermost point 29 of the crotch 25. While a zipper fly closure 26 is shown, other types of closures 26 such as a button fly or the like are clearly contemplated.

Figure 3:
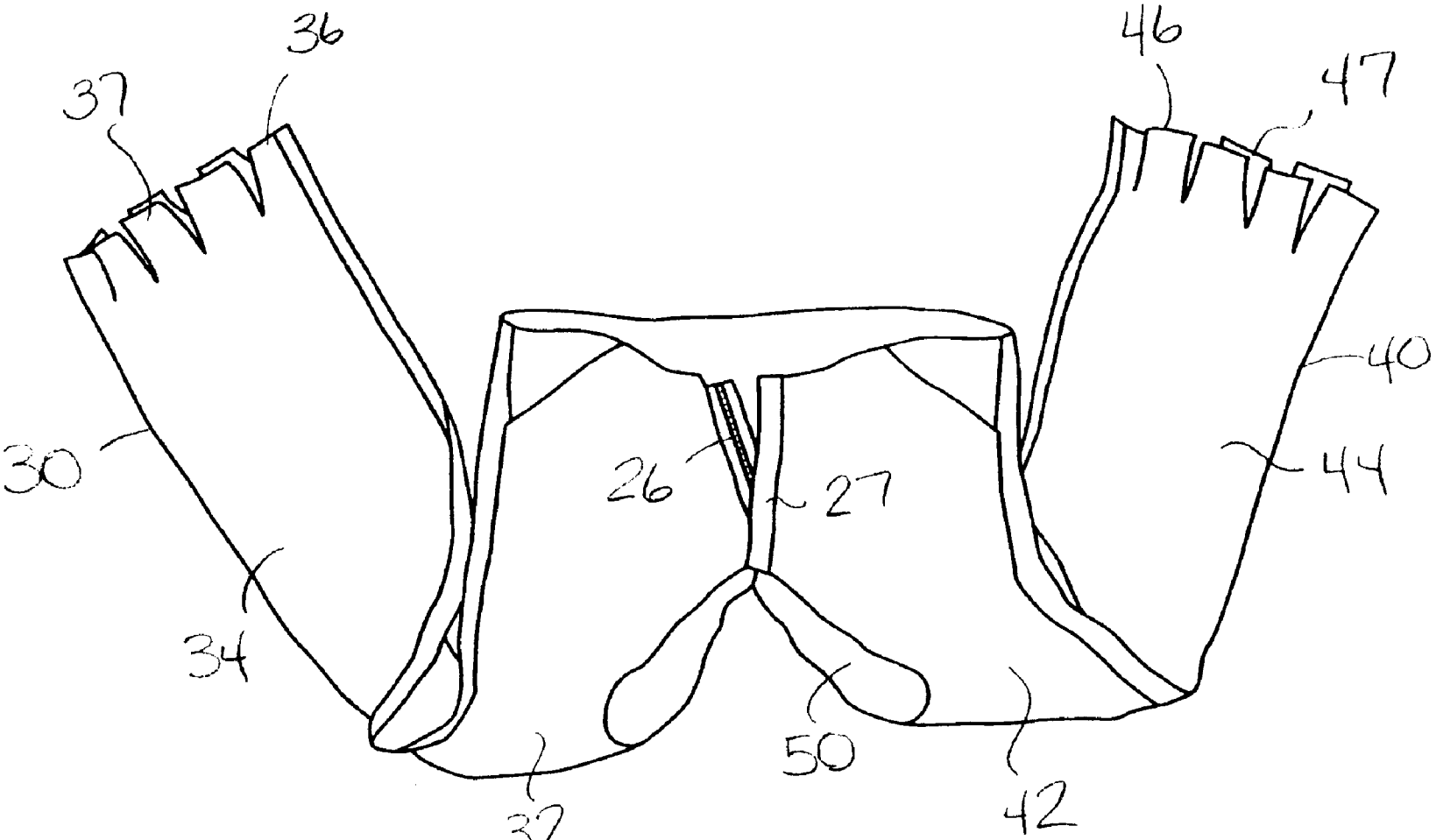
FIG. 3 illustrates the pants of FIG. 2 with decorated leg ends.

The first step of converting the pants 10 of FIG. 1 into a modified clothing article is usually to remove the waist portion 15 as shown in FIG. 1. In the illustrated embodiments, the waist portion 15 is removed. In some cases, this may provide a more comfortable fit for the wearer. However, in other cases, it may be necessary or preferred to retain the waist portion to create a unique appearance. Thus, while it may be preferred with certain garment designs, it is not critical that the waistband be removed. Similarly, and while also not a critical step in the method of producing the convertible garment of the present invention, the ends 36, 46 of the legs 30, 40 may be cut or otherwise decorated to form decorated ends 37, 47 as shown in FIG. 3.

Figure 2:
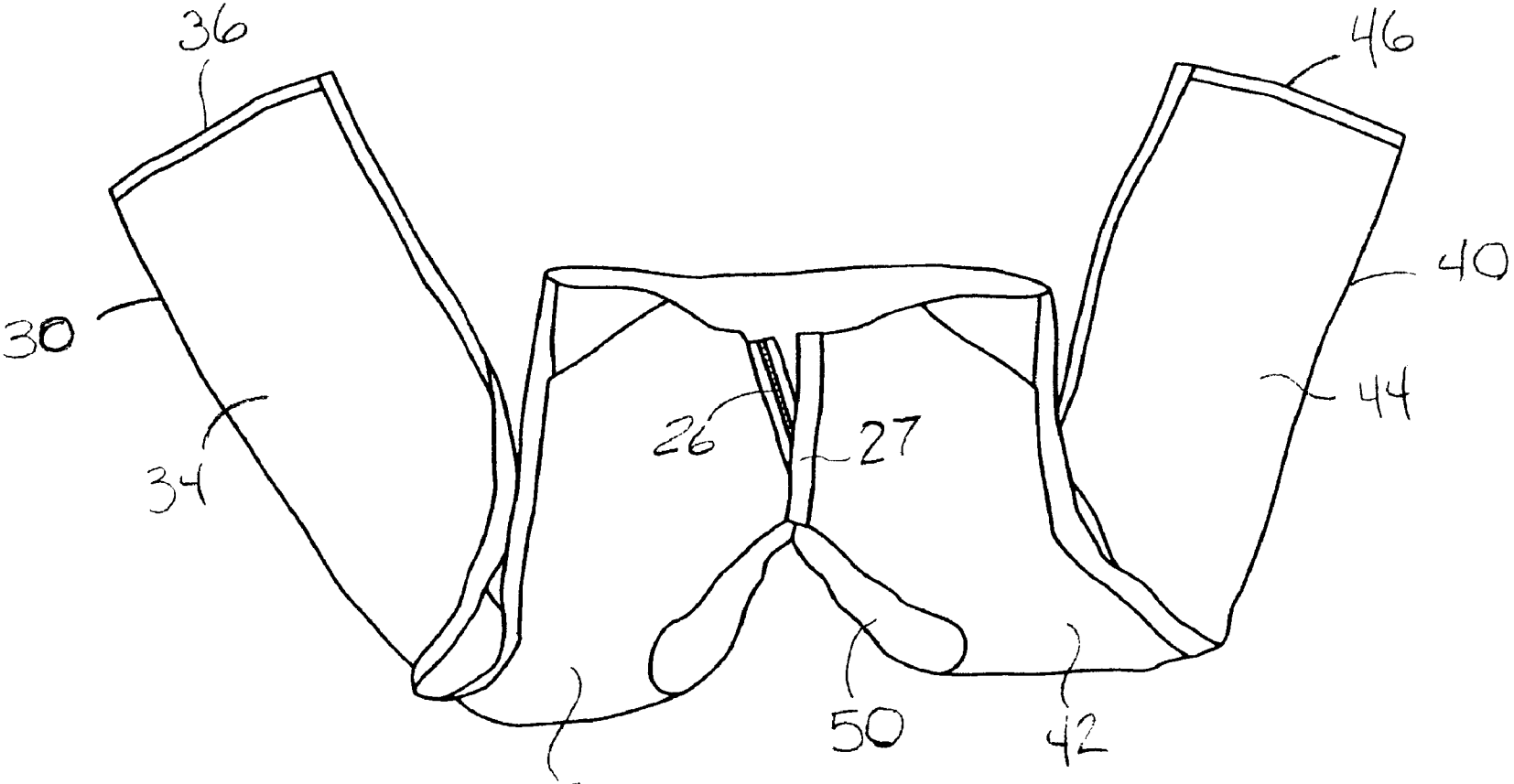
FIG. 2 illustrates the pants of FIG. 1 with a portion of the crotch removed.
Figure 4:
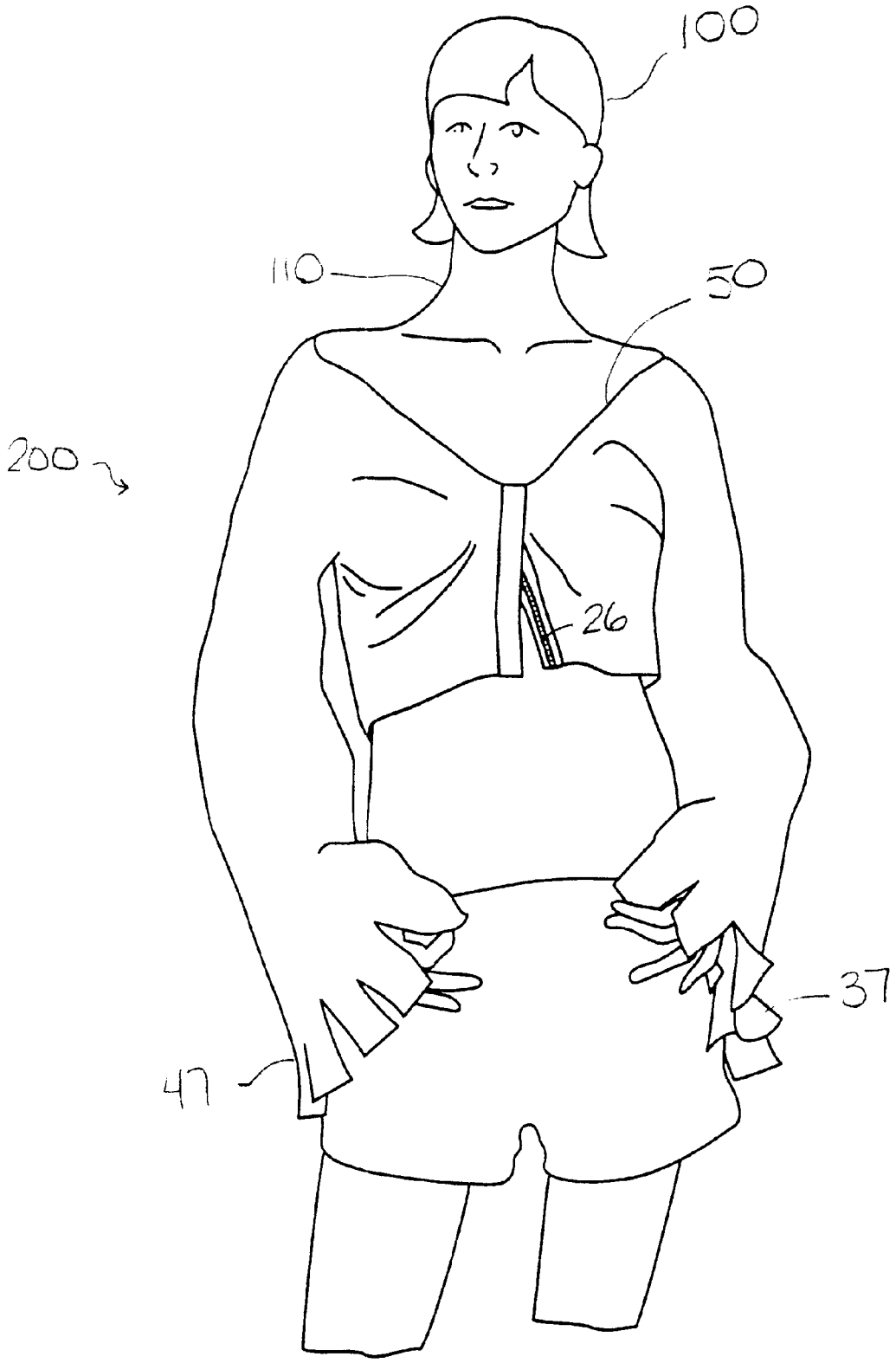
FIG. 4 illustrates a person wearing the garment of the invention on the upper body.

Following the removal of the waist portion 15, a portion from the crotch 25 is removed as shown in FIG. 2, with the removed crotch portion being dimensioned to define a neck portion 50 that fits around a wearer's head 100 and neck 110 (see FIG. 4). The neck portion 50 is preferably defined between the legs 30, 40, spanning between front and back panels of the legs, and preferably extending to a location just before the terminal end 27 of the closure 26.

Figure 5:
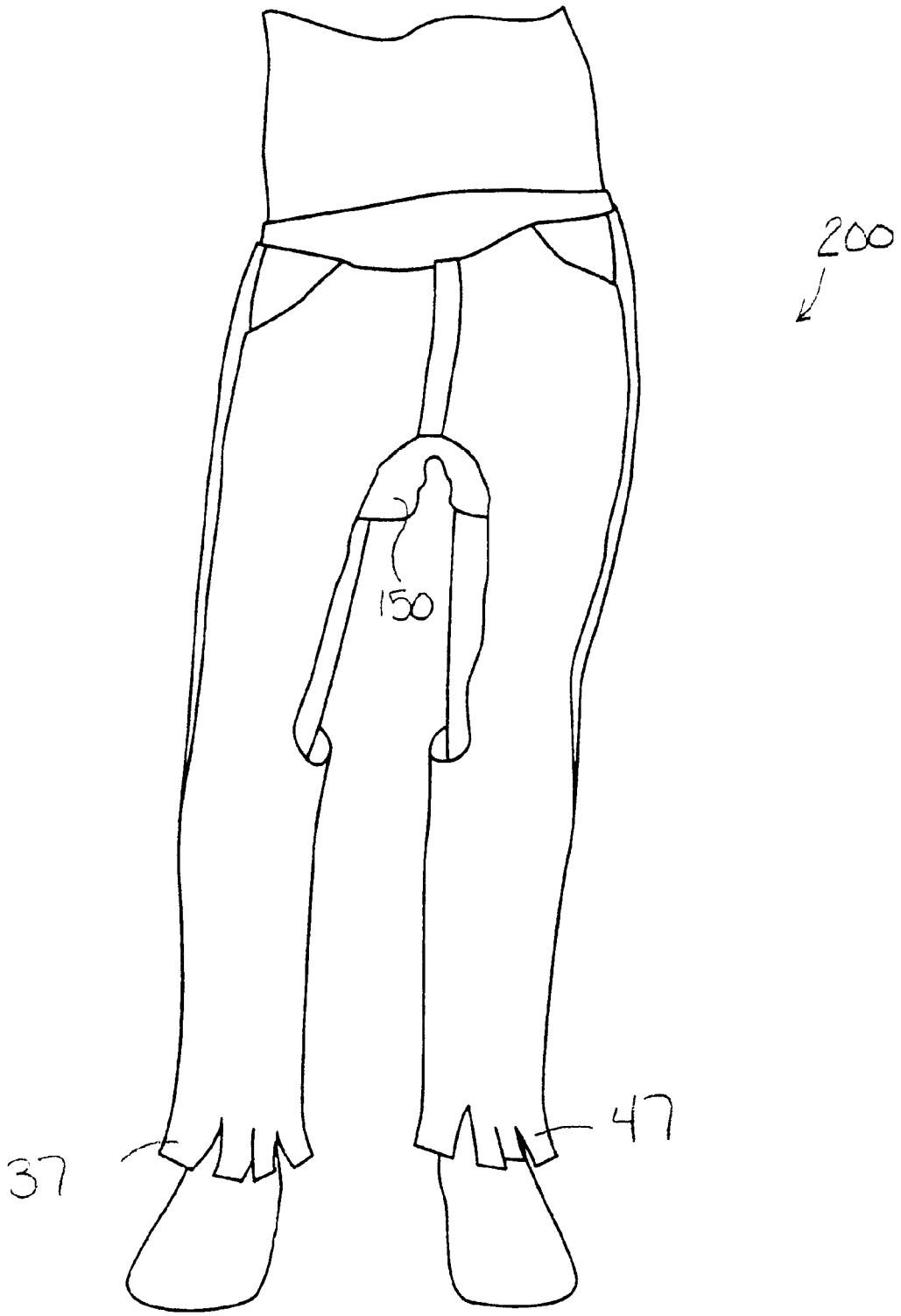
FIG. 5 illustrates a person wearing the garment of the invention on the lower body.
Figure 6:
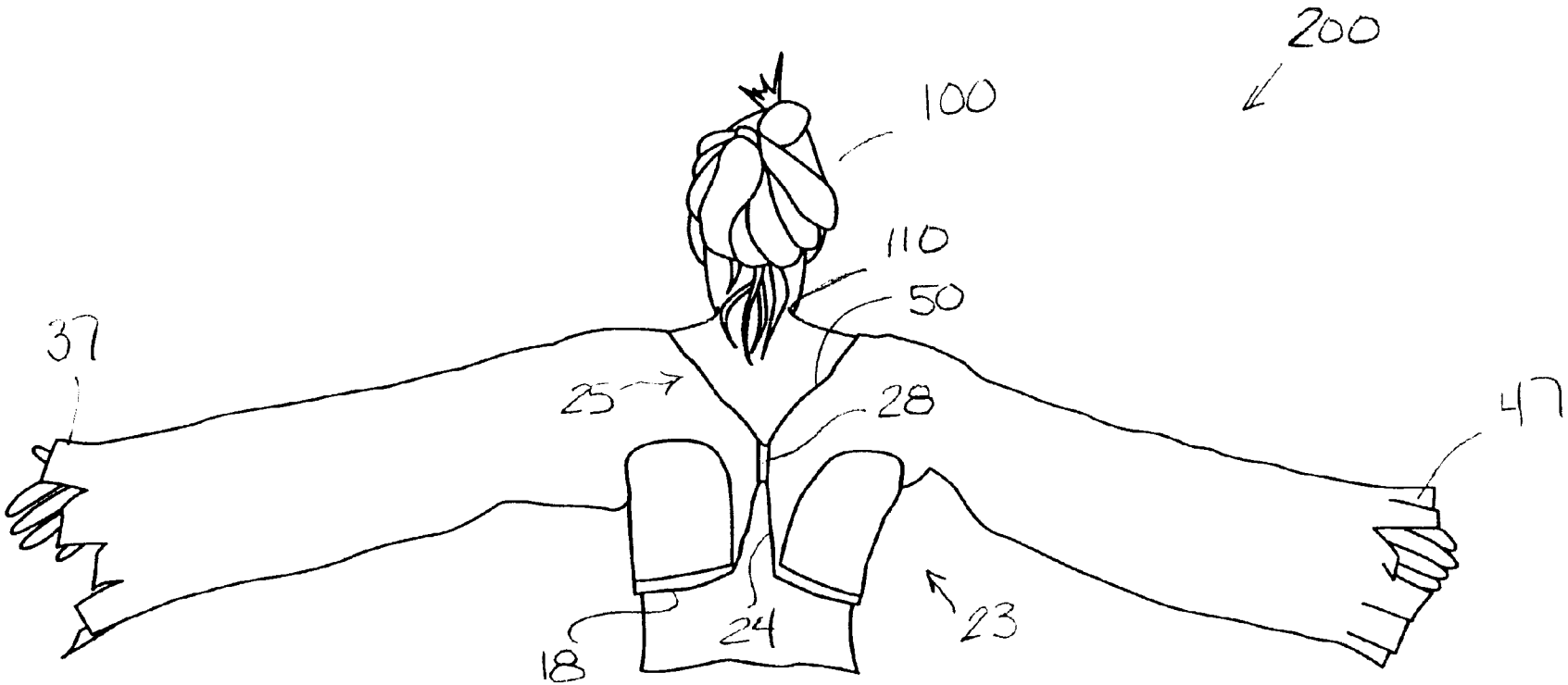
FIG. 6 illustrates an alternative embodiment of the garment of the invention as viewed from the back of a wearer.

FIGS. 4 and 6 illustrate the modified garment 200 of the invention being worn on the upper body, while FIG. 5 illustrates the modified garment 200 being worn on the lower body. As shown in FIG. 4, the removed crotch portion becomes the neckline 50 of the garment 200, while the decorated leg ends 37, 47 become the sleeve ends of the garment 200. While the garment 200 is worn on the upper body, the closure 26 can be fully or partially opened as shown to reveal just under the breast area of the wearer, or it can be closed to mimic a belly shirt. Of course, the leg-type garment could include a button-down fly instead of a zipper fly, in which case the ornamental appearance of the garment on the wearer would be different. A button fly would also allow the wearer to vary the amount of belly exposure at predetermined increments, while a zipper fly might have a tendency to open too much during use.

As shown in FIG. 5, the modified garment of the invention 200 may also be worn on the legs with an undergarment 150 worn underneath. Such undergarment 150 may be a pair of stockings, leggings, thin sweatpants, shorts or conventional underwear. If the garment of the invention 200 is to be worn predominantly on the legs, it would be preferable if the garment was originally provided with a button fly, which would better hold the garment together around the waist. It would also be preferable for the wearer if the waist portion 15 was retained and not removed as illustrated in FIG. 1. Even if the waist portion 15 is fully or partially retained, the convertible garment of the present invention 200 could still be worn on the upper body and the lower body as shown in FIGS. 4–6.

As shown in FIG. 6, the back 23 of the modified garment 200 may be modified with a cut 24 extending from the waist edge 18 downward toward the removed crotch portion (now the neck portion 50), although a small portion 28 of the crotch 25 should be retained between such cut and the removed crotch portion to keep the back 23 of the garment together. A cut 24 along the back of the garment 200 also makes the garment 200 more flexible. If worn by a female, the retained portion 28 of the garment extending along the back might be viewed to mimic a bra closure.

If the original leg-type garment 10 (FIG. 1) is a pair of sweatpants that did not originally have a fly-type opening 26, then the front of the garment 22 could be cut in an appropriate fashion to replicate a fly-type opening. In this case, however, it might be better if the front of the garment did not have a cut fly-type opening, particularly if the garment is to be worn on the legs.

The garment of the invention may be decorated as desired by the wearer. For example, the ends of the legs 36, 46 may be cut differently than shown in FIG. 4, while other portions of the garment may include cutouts or ornamentation in addition to what is shown in the FIGS. 1–6. The closure 26 may also be decorated with ribbon, beads or the like (not shown), since the closure 26 extends along the center of the wearer's chest when worn. In addition, the seams of the garment may be decorated or patterned to give the garment a unique appearance overall.

Figure 7:
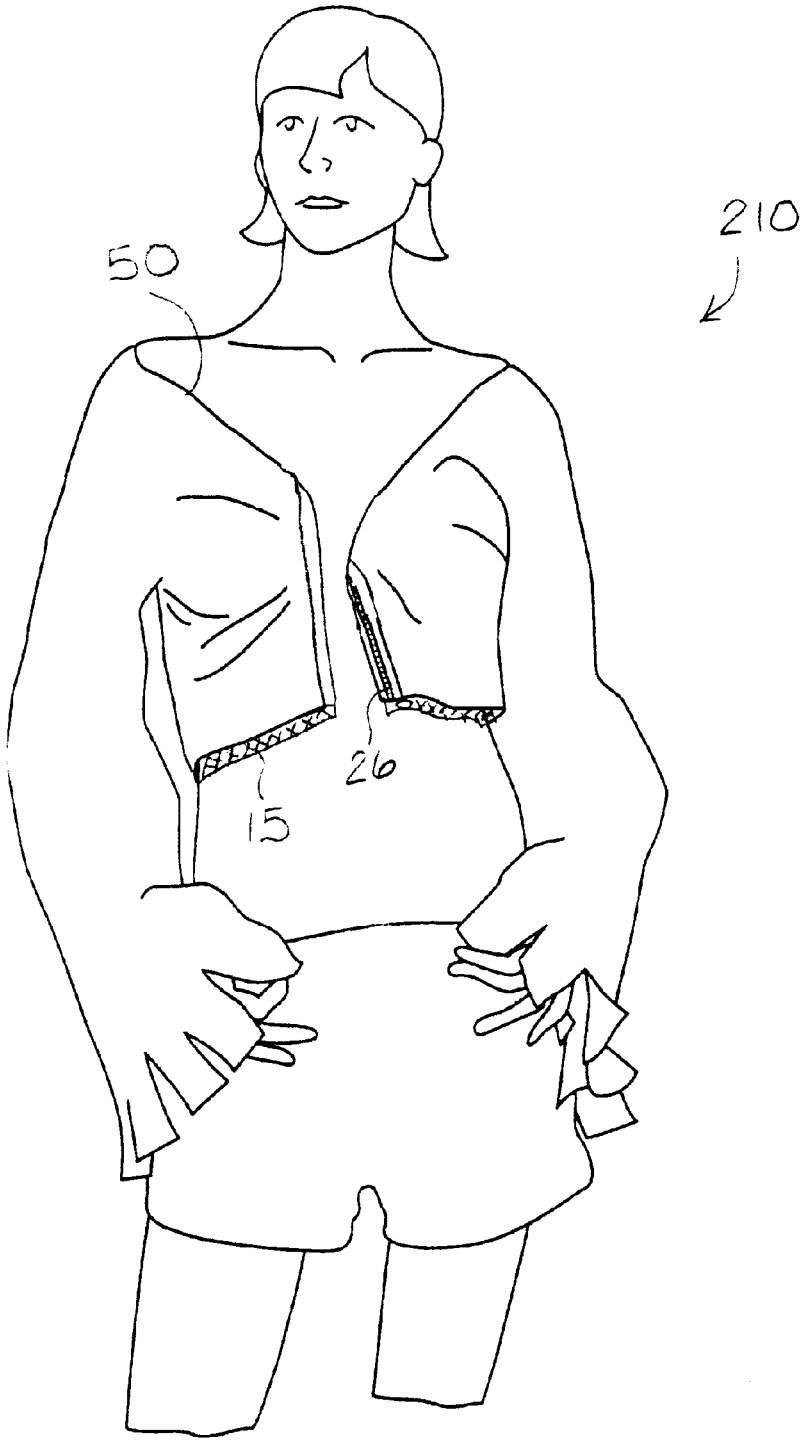
FIG. 7 illustrates a person wearing an alternative embodiment of the garment of the invention as a jacket on the upper body.

In an alternative embodiment shown in FIG. 7, the crotch portion may be completely severed in the front so that the garment of the invention 210 can be worn as a jacket. In this situation, it may be preferred to maintain the waist portion 15 attached to the pants so that the garment 210 can also be worn on the legs in the manner shown in FIG. 5. If worn as a jacket as shown in FIG. 7, the neck portion 50 can be dimensioned so that the jacket terminates above the belly as shown, or below the belly and extending to the hips as would a normal multi-seasonal jacket.

Figure 8:
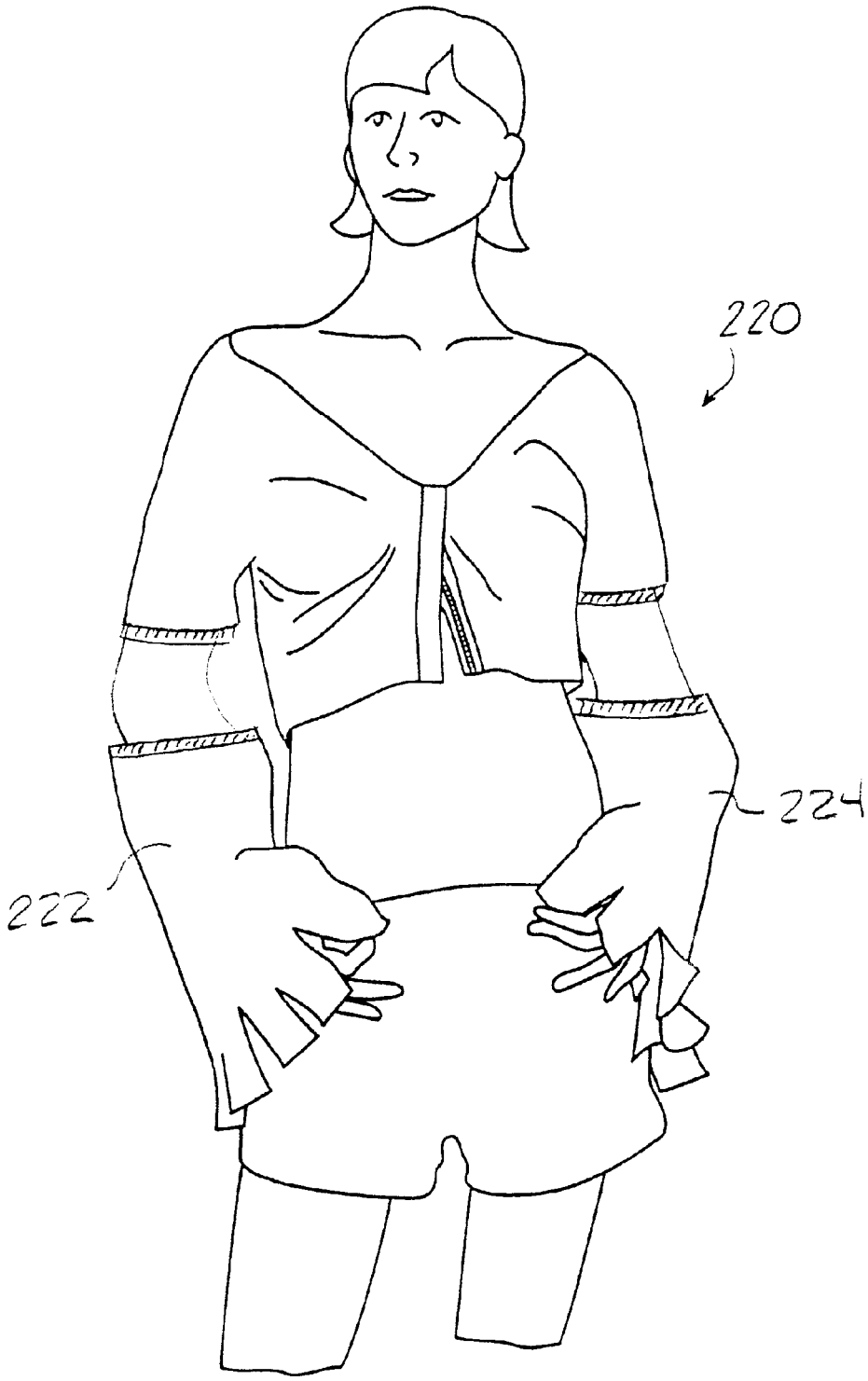
FIG. 8 illustrates an alternative embodiment of the garment of the invention having detachable sleeve portions.
Figure 9:
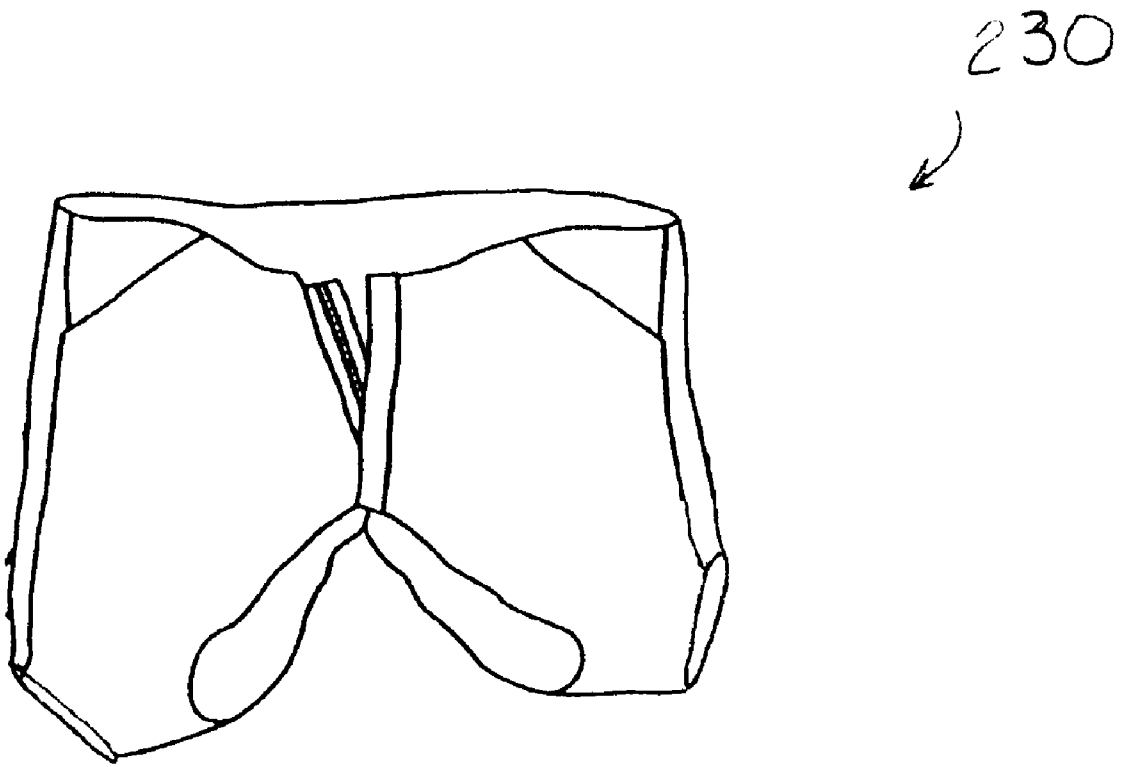
FIG. 9 illustrates an alternative embodiment of the garment of the invention with the leg portions removed.

In a further alternative embodiment shown in FIG. 8, the back 23 of the garment of the invention 220 may have detachable sleeve portions 222, 224, which allow the garment 220 to be worn on the upper body as a short-sleeved shirt, or on the lower body as shorts. Such sleeve portions 222, 224 may be detachable by way of zippers, buttons, straps or the like. Similarly, in a further alternative embodiment shown in FIG. 9, the leg portions may be completely removed, in which case the modified garment of the invention 230 may be worn as a vest on the upper body, or short shorts on the lower body.

Figure 10:
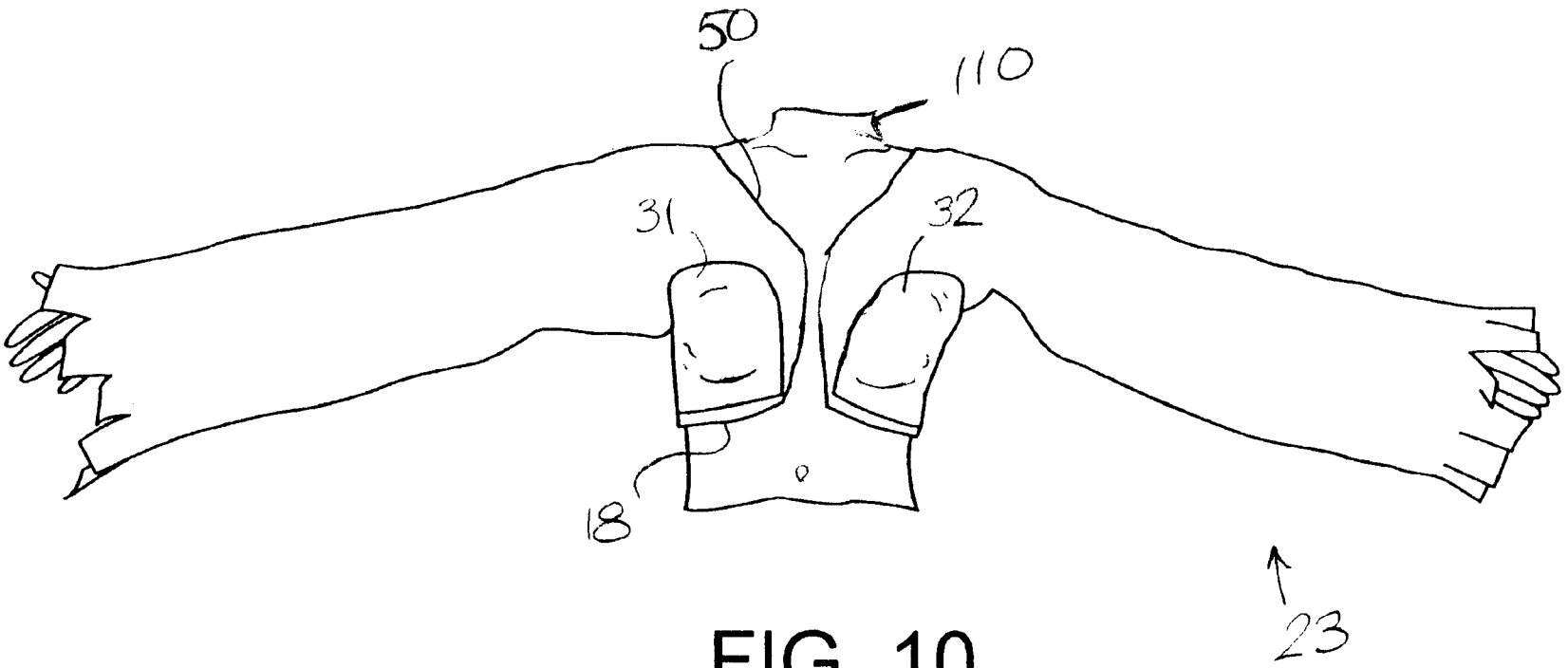
FIG. 10 illustrates an alternative embodiment of the garment of FIG. 6.

In a further alternative embodiment shown in FIG. 10, which is a modification of the garment 200 of FIG. 6, the small portion 28 (FIG. 6) is removed so that the garment can be worn as a jacket with back 23 positioned over the wearer's chest. Thus, the back pockets 31, 32 would be primarily visible from the wearer's front.

Thus, there has been disclosed a method of converting a conventional pair of jeans, pants or the like into garment that can be worn on the upper body as well as the lower body. Now, instead of throwing out jeans that don't fit, one can convert such jeans into an aesthetically appealing upper body garment. In addition, the method of the present invention can be used to convert reject-type garments, i.e., imperfect garments not suitable for retail or wholesale distribution, into a fashionable commodity.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A convertible garment adapted to be worn on a person's lower body and upper body, comprising:

a) a front, a back, a waist and a closure depending from said waist, b) first and second legs depending from said waist and terminating in first and second leg ends, c) a crotch defined between said first and second legs, and d) a neck opening defined between said first and second legs by the removal of a portion of the crotch, e) wherein said waist is discontinuous along at least one of said front and said back, and f) wherein said neck opening is sizably dimensioned to allow a person to wear the convertible garment on the upper body and the lower body with the legs being worn as arm sleeves when the convertible garment is worn on the upper body.

2. A convertible garment in accordance with claim 1, wherein each of said legs ends is aesthetically altered.

3. A convertible garment in accordance with claim 2, wherein each of said legs ends is cut in a plurality of locations.

4. A convertible garment in accordance with claim 1, wherein said waist is discontinuous at a first location along said front and at a second location along said back.

5. A convertible garment in accordance with claim 1, wherein said closure further comprises a terminus, and wherein said neck opening is defined between said closure terminus and a back portion.

6. A convertible garment in accordance with claim 5, wherein said back portion is spaced from said waist.

7. A convertible garment in accordance with claim 4, wherein said closure further comprises a terminus, and wherein said neck opening is defined between said closure terminus and a back portion.

8. A convertible garment in accordance with claim 7, wherein said back portion is spaced from said waist such that a back opening is defined between said back portion and said second location, said back portion being further defined between said neck opening and said back opening.

9. A convertible garment in accordance with claim 1, wherein said front has an upper portion defined between said waist and said neck opening, and wherein said front upper portion further comprises right and left side panels that are separated by said closure and a closure terminus, and wherein said closure is adapted join and separate said right and left side panels respectively.

10. A convertible garment in accordance with claim 1, wherein a portion of each leg is removable from said garment.

11. A convertible garment in accordance with claim 10, wherein each of said legs is removed from garment.

12. A convertible garment in accordance with claim 5, wherein said neck opening extends to said first location along said waist.

13. A convertible garment in accordance with claim 1, wherein said waist further comprises a waist closure.

14. A convertible garment in accordance with claim 13, wherein said waist closure and said closure depending from said waist are different.

15. A method of making a convertible garment from an article of clothing that is normally worn on a person's lower body, said article of clothing having a waist portion, a seat portion and first and second leg portions depending from said seat portion, said seat portion having a front and a back, said leg portions terminating in leg ends and a crotch portion defined between said first and second leg portions, said method comprising the steps of:

a) removing the waist portion from the seat portion, and b) removing the crotch portion to define a neck opening, c) said neck opening being sizably dimensioned to allow a person to wear the convertible garment on the upper body and the lower body with the leg portions being worn as arm sleeves when the convertible garment is worn on the upper body.

16. A method in accordance with claim 15, further comprising the step of aesthetically altering the legs.

17. A method in accordance with claim 15, wherein said seat portion further comprises a front closure having an upper terminus and a lower terminus, and wherein said neck opening is defined between said back of said seat and said closure lower terminus.

18. A method in accordance with claim 17, further comprising the step of removing said closure terminus so that said neck opening extends from said back of said seat to said closure upper terminus and so that said convertible garment can be worn as a jacket.

19. A method in accordance with claim 15, wherein said first and second leg portions are removable from said seat portion.

20. A method in accordance with claim 16, further comprising the step of aesthetically altering the leg ends.

* * * * *